US008179031B2

(12) United States Patent
Ban et al.

(10) Patent No.: US 8,179,031 B2
(45) Date of Patent: May 15, 2012

(54) SURFACE LIGHT SOURCE, METHOD OF DRIVING THE SAME, AND BACKLIGHT UNIT HAVING THE SAME

(75) Inventors: Seok Mo Ban, Suwon-si (KR); Ki Yeon Lee, Suwon-si (KR); Kyeong Taek Jung, Suwon-si (KR); Hyung Bin Youn, Suwon-si (KR); Keun Seok Lee, Suwon-si (KR); Dong Hee Lee, Suwon-si (KR); Won Do Kee, Suwon-si (KR); Yong Keun Jee, Suwon-si (KR)

(73) Assignee: Samsung Corning Precision Materials Co., Ltd., Gyeongsangbuk-do (KR)

( * ) Notice: Subject to any disclaimer, the term of this patent is extended or adjusted under 35 U.S.C. 154(b) by 286 days.

(21) Appl. No.: 11/901,699

(22) Filed: Sep. 18, 2007

(65) Prior Publication Data

US 2008/0068846 A1 Mar. 20, 2008

(30) Foreign Application Priority Data

Sep. 19, 2006 (KR) ..... 10-2006-0090672

(51) Int. Cl.
*H01J 1/62* (2006.01)

(52) U.S. Cl. ..... 313/491; 313/492; 313/494

(58) Field of Classification Search ..... 313/491, 313/492, 494, 581
See application file for complete search history.

(56) References Cited

U.S. PATENT DOCUMENTS

| | | | | |
|---|---|---|---|---|
| 6,111,560 | A | 8/2000 | May et al. | |
| 6,483,255 | B1 * | 11/2002 | Vollkommer et al. | 315/246 |
| 6,762,556 | B2 * | 7/2004 | Winsor | 313/607 |
| 2005/0077808 | A1 | 4/2005 | Hitzschke et al. | |

FOREIGN PATENT DOCUMENTS

| | | | |
|---|---|---|---|
| JP | 08148119 A | * | 6/1996 |
| JP | 2005-107210 | | 4/2005 |
| JP | 2006147251 A | * | 6/2006 |
| WO | 93/13514 | | 7/1993 |

OTHER PUBLICATIONS

English Translation of JP2006-147251, published Jun. 8, 2006.*
European Search Report, EP 07 11 5885.

* cited by examiner

*Primary Examiner* — Nimeshkumar Patel
*Assistant Examiner* — Mary Ellen Bowman
(74) *Attorney, Agent, or Firm* — Lerner, David, Littenberg, Krumholz & Mentlik, LLP

(57) ABSTRACT

A surface light source includes a plate type light source body having a sealed discharging space formed therein, a plate type electrode unit having a plurality of regions adjacent to at least one major surface of the light source body, and a multiple voltage applying unit operable to apply voltages independently to each of the plurality of regions. In this way, brightness of the surface light source can be controlled independently in each of the plurality of regions and a local dimming for a surface light source can be realized.

16 Claims, 9 Drawing Sheets

SURFACE LIGHT SOURCE, METHOD OF DRIVING THE SAME, AND BACKLIGHT UNIT HAVING THE SAME

CROSS-REFERENCE TO RELATED APPLICATIONS

This application claims priority from Korean Patent Application No. 10-2006-0090672 filed in the Korean Intellectual Property Office on Sep. 19, 2006; the entire contents of which are incorporated herein by reference.

BACKGROUND OF THE INVENTION

1. Technical Field

The present invention relates to a surface light source, a method of driving the same, and a backlight unit having the same. In a more particular embodiment of the invention, a surface light source is capable of varying the brightness applied to individual portions of the area of a liquid crystal panel.

2. Discussion of Related Art

A liquid crystal display displays an image, using the electrical and optical properties of liquid crystal. The liquid crystal display is widely employed in portable computers, communication devices, liquid crystal television receivers, aerospace industry, and the like because volume and weight are smaller and lighter than those of a cathode ray tube (CRT).

The liquid crystal display includes a controlling unit to control a liquid crystal panel and a backlight source to illuminate the liquid crystal panel. The controlling unit includes pixel electrodes arranged on a first substrate, a common electrode disposed on a second substrate, and the liquid crystal panel disposed between the pixel electrodes and the common electrode. There are a plurality of pixel electrodes for each common electrode, to achieve a resolution of the liquid crystal display. The common electrode faces the pixel electrodes. Thin film transistors (TFT) are connected to the pixel electrodes to apply voltages of different levels thereto and a reference voltage of the same level is applied to the common electrode. The pixel electrodes and the common electrode are made of a transparent conductive material.

The light produced by the backlight source passes through the pixel electrodes, the liquid crystal panel, and the common electrode sequentially. In this case, the quality of an image transmitted through the liquid crystal panel significantly depends on the brightness of and uniformity of brightness of the backlight source. Generally, when the brightness and the uniformity of brightness are high, the image quality becomes high.

The backlight source of a conventional liquid crystal display typically employs a bar-shaped cold cathode fluorescent lamp (CCFL) or a dot-shaped light emitting diode (LED). The cold cathode fluorescent lamp has high brightness and long lifespan and generates less heat than an incandescent lamp. On the other hand, The LED has high power consumption, but has excellent brightness. Liquid crystal displays having a CCFL or an LED tend to suffer from nonuniform brightness. In order to increase the uniformity of brightness, the backlight source employing a CCFL or LED as a light source requires optical members, such as a light guide panel (LGP), a diffusion member, and a prism sheet. However, the optical members significantly increase the size and weight of a liquid crystal display employing the aforementioned CCFL or LED.

A flat fluorescent lamp (FFL) has been proposed as the backlight source of the liquid crystal display.

Referring to FIG. 1, a conventional surface light source 100 includes a light source body 110 and electrodes 160 provided at the outer surface of both lateral edges of the light source body 110. The light source body 110 includes first and second substrates facing each other by a predetermined distance. A plurality of partitions 140 are disposed between the first and second substrates to partition a space defined by the first and second substrates into plural discharging channels 120. A sealing member (not shown) is disposed at the rims of the first and second substrates to isolate the discharging channels 120 from the exterior. A discharge gas is injected into discharging spaces 150 in the discharging channels. In order to drive the surface light source to be discharged, an electrode is coated on the first and second substrates or on only one of the first and second substrates to have the same area per a discharging channel in the form of a minus-shaped band or an island electrode. Thus, all the channels discharge uniformly when the surface light source is driven by an inverter. In this way, the surface light source maintains a predetermined degree of brightness during the driving.

SUMMARY OF THE INVENTION

In order to improve image quality of the liquid crystal display and to implement a more clean and natural image, a technology is provided for simultaneously varying the brightness of individual regions of the surface light source.

Therefore, in an embodiment of the present invention, a new surface light source is provided, suitable for a large-sized liquid crystal display.

In one embodiment, a surface light source and a backlight unit are provided which are capable of independently controlling the brightness of individual regions thereof.

In accordance with an aspect of the present invention, a surface light source comprises a plate type light source body having a sealed discharging space formed therein, a plate type electrode unit adjacent to at least one major surface of the light source body, and a multiple voltage applying unit operable to apply voltages independently to each of a plurality of regions of the electrode unit.

The electrode unit may comprise electrode patterns spaced apart from each other. In a case of the electrode units being formed on the upper side and the lower side of the light source body, each electrode unit may comprise electrode patterns formed in different directions.

In accordance with an aspect of the invention, method of operating a surface light source is provided, comprising applying voltages independently to each of a plurality of partitioned regions of a plate type electrode unit having a property of transmitting visible rays therethrough on a plate type light source body having a sealed discharging space. One embodiment of the present invention provides a backlight unit comprising a surface light source, a case and an inverter. The surface light source comprises a plate type light source body having a sealed discharging space formed therein, a plate type electrode unit adjacent to at least one major surface of the light source body, and a multiple voltage applying unit operable to apply voltages independently to each of a plurality of regions. A case may accommodate the surface light source and an inverter can be used to apply voltages to first and second surface electrodes.

In the surface light source and the backlight unit according to one embodiment of the present invention, the electrode unit is partitioned into plural regions and voltages are applied to respective regions so that brightness of each region can be independently controlled. In this way, local dimming of the surface light source can be provided in accordance with screen information of the liquid crystal display to enable a clearer and more natural image to be obtained.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

The present invention will now be described more fully hereinafter with reference to the accompanying drawings, in which preferred embodiments of the invention are shown.

Figure 1:
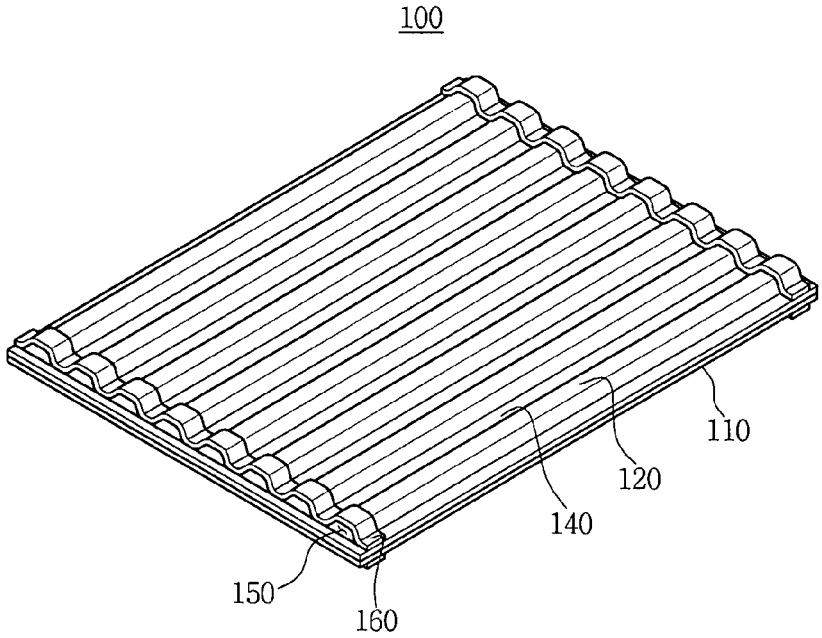
FIG. 1 is a perspective view illustrating an example of a surface light source.
Figure 2:
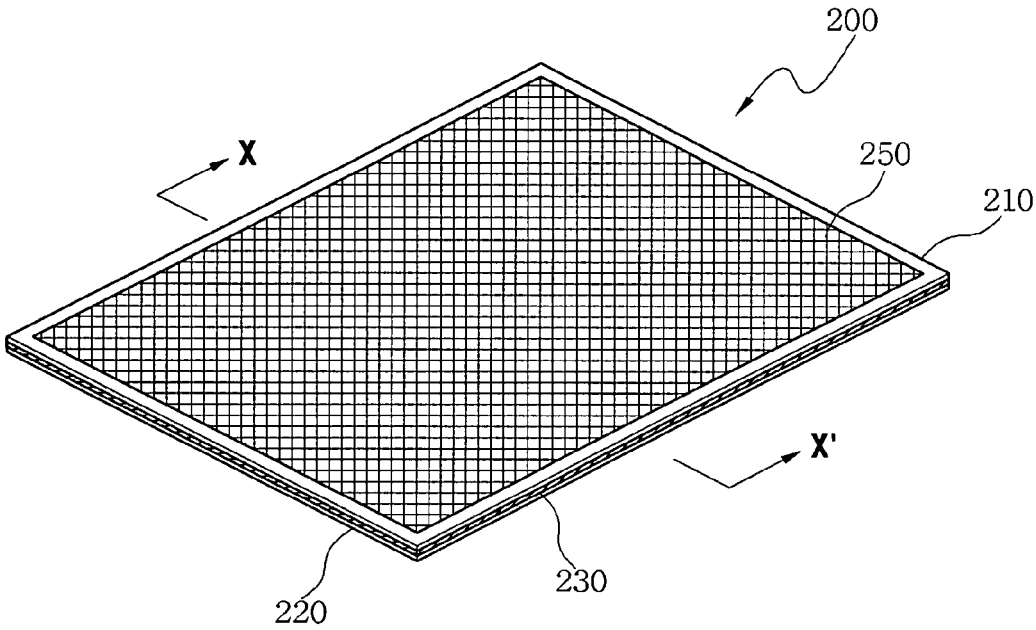
FIG. 2 is a perspective view illustrating a surface light source according to an embodiment of the present invention.
Figure 3:
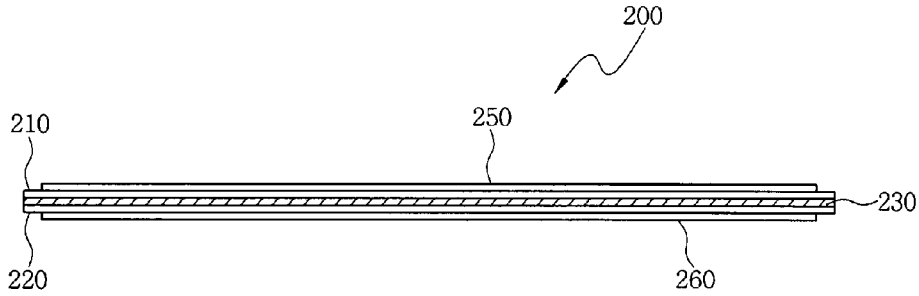
FIG. 3 is a side view illustrating the surface light source according to the embodiment of the present invention.

FIG. 2 is a perspective view illustrating a surface light source 200 according to an embodiment of the present invention, and FIG. 3 is a side view of the surface light source 200.

The surface light source 200 includes a plate type first substrate 210 and a same type second substrate 220. The first substrate 210 and the second substrate 220 are preferably made of transparent thin glass substrate, and have no restriction for thickness, but may have a thickness of about 1 mm to 2 mm, preferably, less than 1 mm.

A fluorescent layer is coated on the inner sides of the first and second substrates 210 and 220, and a reflective layer may be further formed on any one of the first and second substrates 210 and 220. The first substrate 210 and the second substrate 220 face each other by a predetermined distance and a sealing member 230 such as frit is inserted between edges of the substrates 210 and 220 to form a sealed space. Otherwise, the first substrate 210 and the second substrate 220 may be directly welded to each other by a heating device such as laser to form the light source body.

The surface light source of the present invention can be implemented by a thin structure with very thin thickness. The light source body formed by the first substrate, the second substrate, and the sealing member includes a single open-structured inner discharging space. A discharge gas which does not contain mercury can be injected into the discharging space such that a light source body can be provided for use in an environmentally friendly product.

Figure 4:
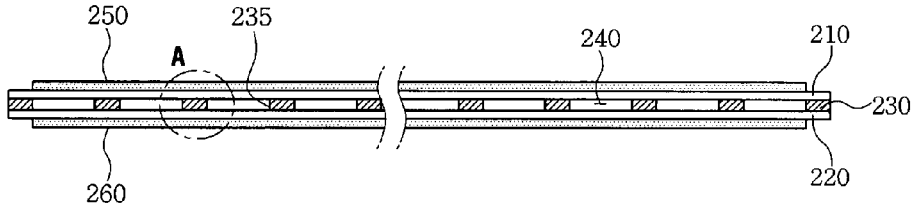
FIG. 4 is a sectional view taken along the line X-X' in FIG. 2.
Figure 5:
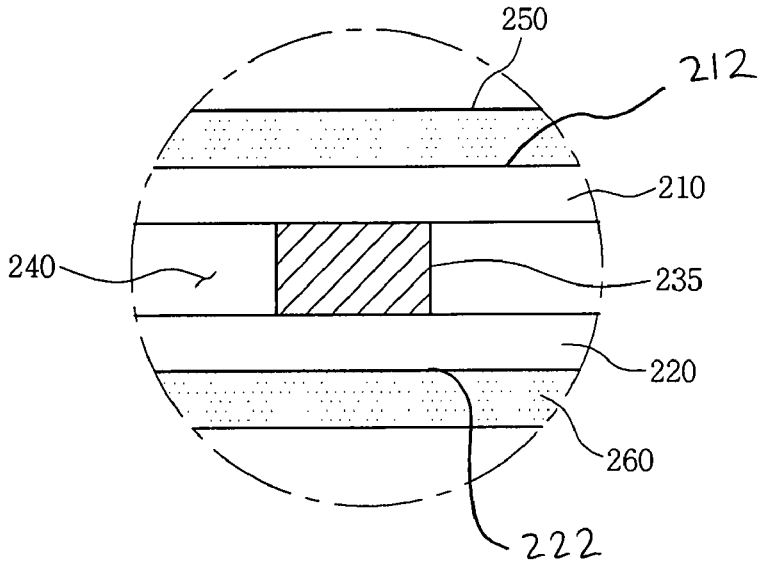
FIG. 5 is an enlarged view of a portion A in FIG. 4.

The surface light source according to the embodiment of the present invention includes large-sized plate type electrodes formed on the outer surfaces of the light source body formed by the first and second substrates 210 and 220. FIG. 4 is a sectional view taken along the line X-X' in FIG. 2, and FIG. 5 is an enlarged view of a portion A in FIG. 4. As illustrated, a first surface electrode 250 and a second surface electrode 260 are formed on or adjacent to the outer major surfaces 212 and 222 of the first and second substrates 210 and 220, respectively. The first and second surface electrodes 250 and 260 are plate type surface electrodes to substantially cover overall area of the substrates.

At least one of the first and second surface electrodes 250 and 260 has preferably an open ratio of 60% or higher. In this way, light transmitted from the light source body due to the discharge is increased.

The first substrate 210 and the second substrate 220 are plate type substrates. The inner space defined by the first and second substrates 210 and 220 and the sealing member 230 is not an individual discharging space separated by a partition. Rather, the inner space is a single open-structured discharging space 240. The distance between the first and second substrates 210 and 220 is very short in comparison to the area of the substrates 210 and 220 and the inner space is a open structure so that vacuum ventilation and the injection of the discharging gas are very easily performed. A gas other than mercury as the discharging gas, such as xenon, argon, neon, and other inactive gas, or gas mixture thereof can be used as a discharging gas to form the surface light source.

A vertical height of the discharging space 240 defined between the first and second substrates 210 and 220 can be determined by a spacer 235. The number of the spacers 235 and the interval between the spacers 235 may be determined within a range where the brightness property of light beam emitted from the surface light source is not adversely affected. Otherwise, a characteristic of the spacer may be artificially added, by molding certain parts of an upper substrate. Otherwise, the height of the discharge space 240 may be defined by protrusions (not shown) formed integrally with the inner surface of the first substrate 210 or second substrate 220. Since the discharging space is not divided by a partition in the surface light source according to the embodiment of the present invention, brightness and brightness uniformity of the light beam emitted from the front side of the substrates 210 and 220 are excellent.

Figure 6:
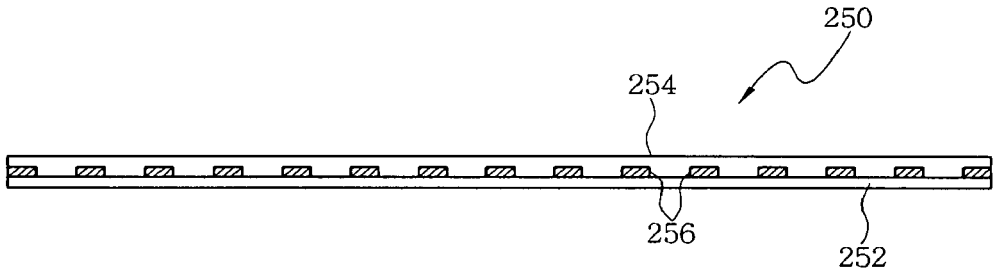
FIG. 6 is a sectional view illustrating a multi-layer electrode unit according to an embodiment of the present invention.

In the surface light source according to the embodiment of the present invention, the first surface electrode 250 and the second surface electrode 260 may employ transparent electrodes such as ITO or electrodes with predetermined patterns. FIG. 6 is a sectional view illustrating a multi-layer electrode unit according to the embodiment of the present invention. As illustrated, the electrode unit has a multi-layer structure including a lower base layer 252, an electrode pattern 256 formed on the base layer 252, and a protective layer 254 formed on the base layer 252 and the electrode pattern 256.

The base layer 252 and the protective layer 254 preferably are transparent with respect to visible rays.

In a case of an electrode unit including only the electrode pattern, the electrode unit is difficult to be bonded to a glass substrate and has inferior durability. However, the multi-layer structured electrode unit is easily bonded to the glass substrate, the electrode pattern has a sufficient durability, and various electrode patterns can be formed.

The base layer 252 is made of a material capable of resisting thermal shock such as transparent polymer, and the electrodes may be made of copper, silver, gold, aluminum, nickel, chrome, carbon or polymer based material with excellent conductivity, and mixture thereof. The protective layer 254 is made of transparent polymer material capable of resisting thermal shock.

Figure 7:
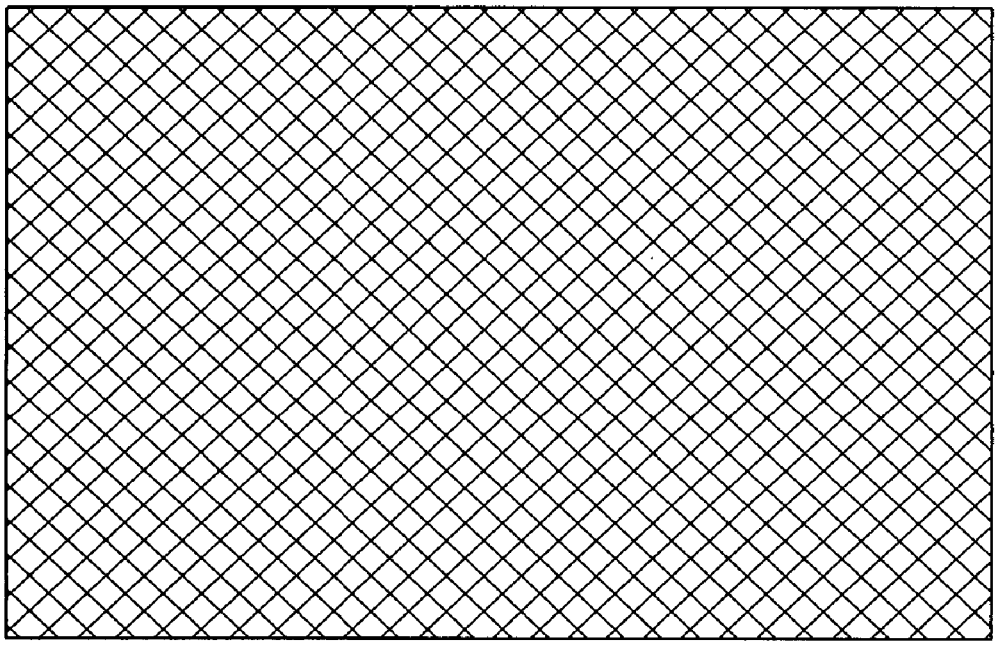
FIGS. 7 to 9 are plan views illustrating various examples of electrode patterns of the electrode unit according to the embodiment of the present invention.
Figure 8:
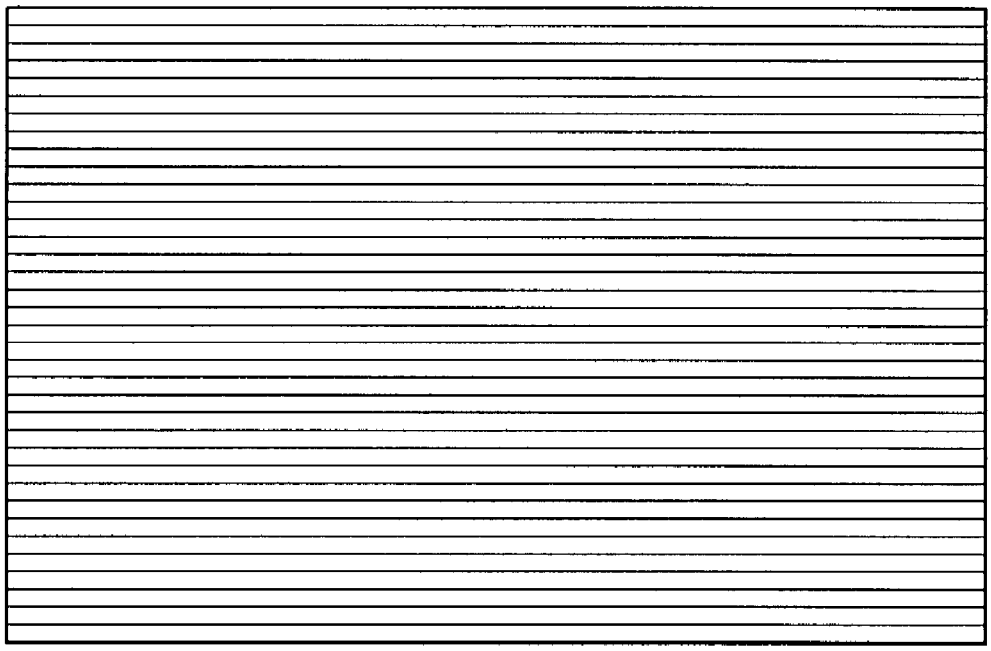
Figure 9:
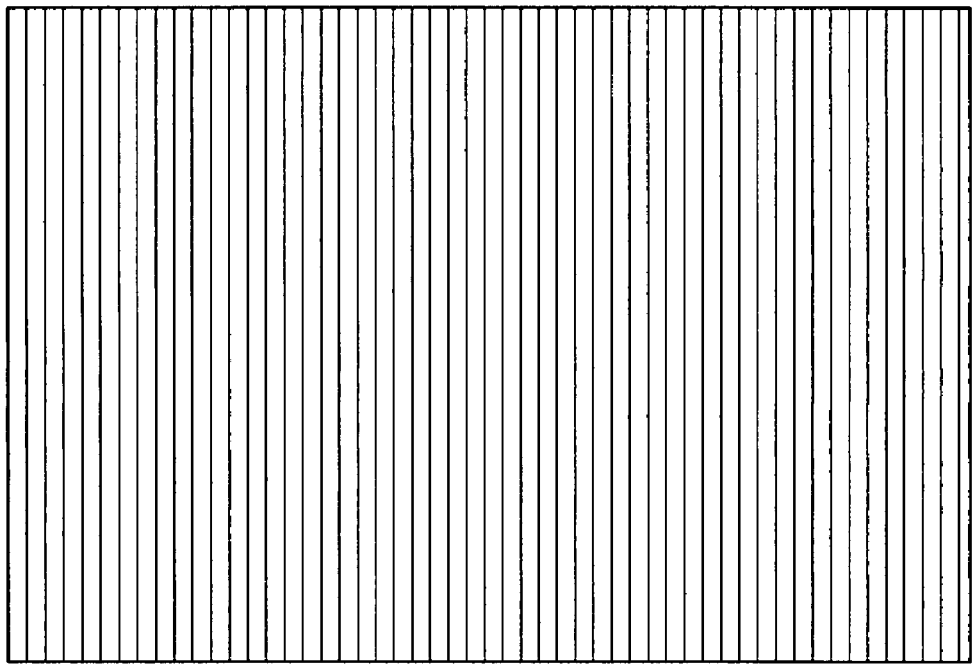

Various electrode patterns may be used in the plate type electrode unit employed in the surface light source according to the embodiment of the present invention. For example, a net type electrode pattern as illustrated in FIG. 7 or a stripe type pattern as illustrated in FIGS. 8 and 9 may be used. Different from those illustrated in the drawings, circular, oval, or polygonal regular patterns may be used. The first surface electrode 250 formed on the first substrate 210 and the second surface electrode 260 formed on the second substrate 220 may have different electrode patterns in shape, thereby changing the discharge characteristic of the surface light source.

The electrode patterns may be formed such that a pitch between adjacent patterns is from tens of micrometers to hundreds of micrometers.

In the plate type electrode unit, the electrode patterns may be grouped to permit voltages to be applied individually to respective groups. As such, the electrode unit is partitioned into a plurality of regions and voltages are applied to the respective regions individually so that the brightness of each respective region can be individually controlled.

Figure 10:
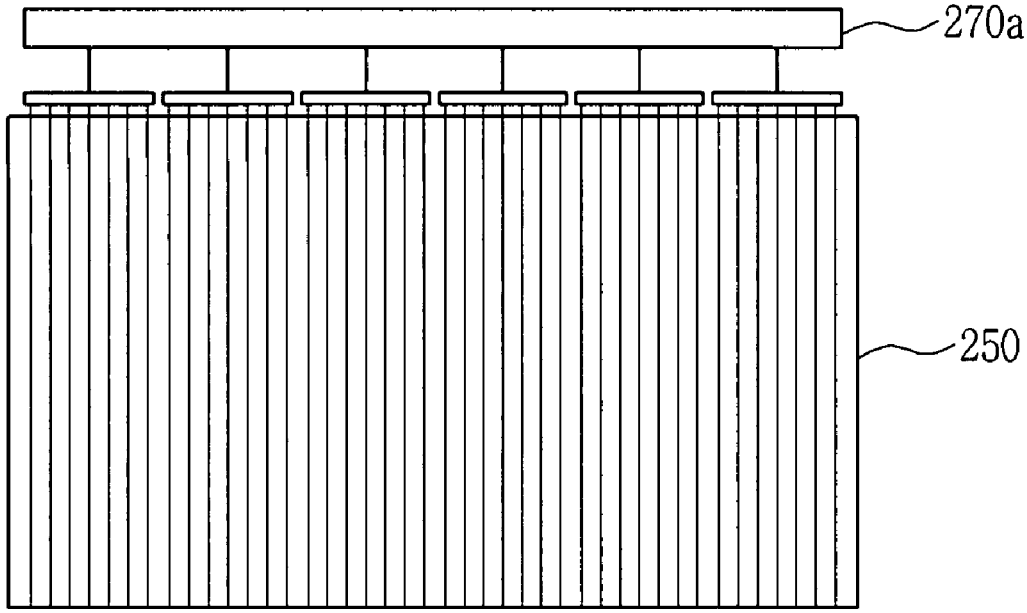
FIG. 10 is a plan view illustrating the electrode unit vertically partitioned and driven with respect to a long side of the surface light source.
Figure 11:
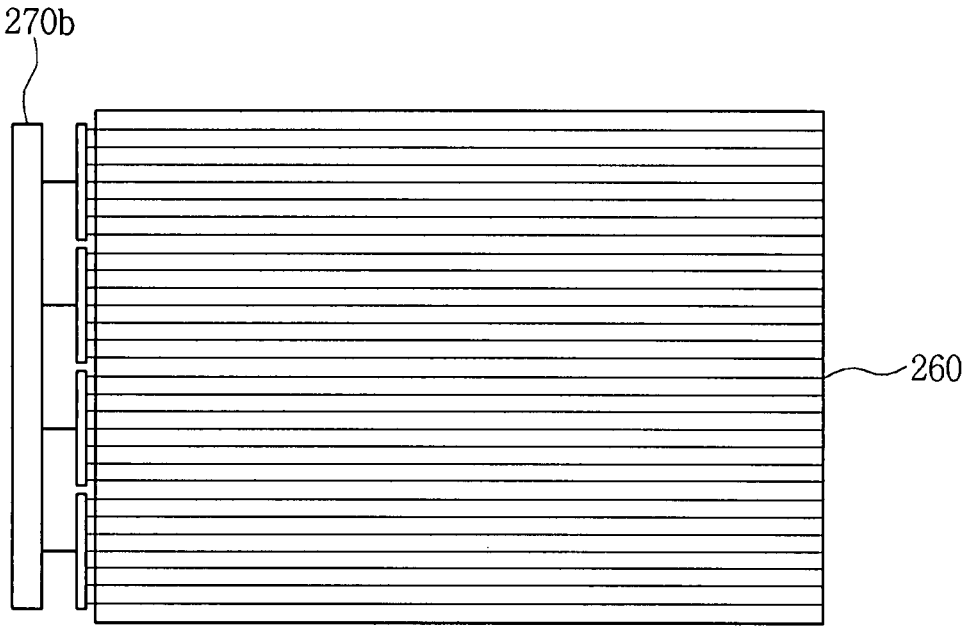
FIG. 11 is a plan view illustrating the electrode unit horizontally partitioned and driven with respect to the long side of the surface light source.

FIGS. 10 and 11 schematically illustrate multiple divisional driving of the electrode unit of the surface light source according to the embodiment of the present invention. As illustrated in FIG. 10, the electrode pattern of the first surface electrode (or the upper electrode) 250 is partitioned into predetermined regions and voltages are individually applied to the respective regions. A multiple voltage applying unit 270*a* can apply different voltages to the respective regions of the electrode pattern. As illustrated in FIG. 11, the electrode pattern of the second surface electrode (or the lower electrode) 260 is partitioned into predetermined regions and voltages are individually applied to the respective regions. FIG. 10 illustrates an example of partitioning the electrode unit with respect to the long side of the surface light source in the vertical direction to drive the electrode unit and FIG. 11 illustrates an example of partitioning the electrode unit with respect to the long side of the surface light source in the horizontal direction to drive the electrode unit.

Figure 12:
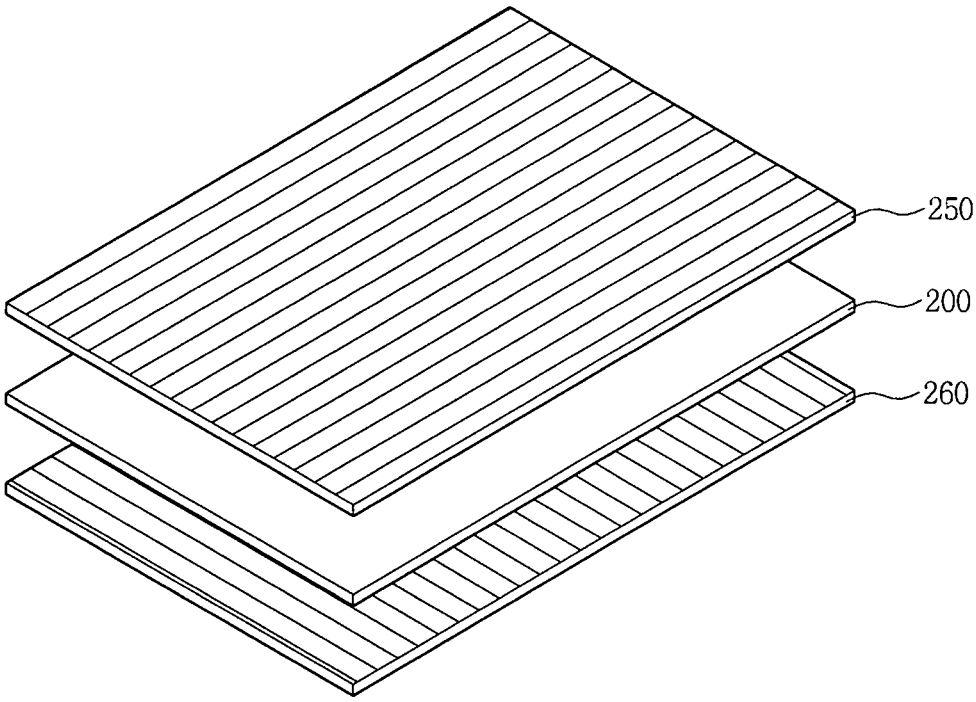
FIG. 12 is a perspective view illustrating the electrode unit attached to the upper side and the lower side of the surface light source.

As illustrated in FIG. 12, when electrode units have the electrode patterns formed on or adjacent to an upper side (first major surface) and a lower side (second major surface) of the surface light source in different directions, the brightness of individual regions may be more easily controlled.

Figure 13:
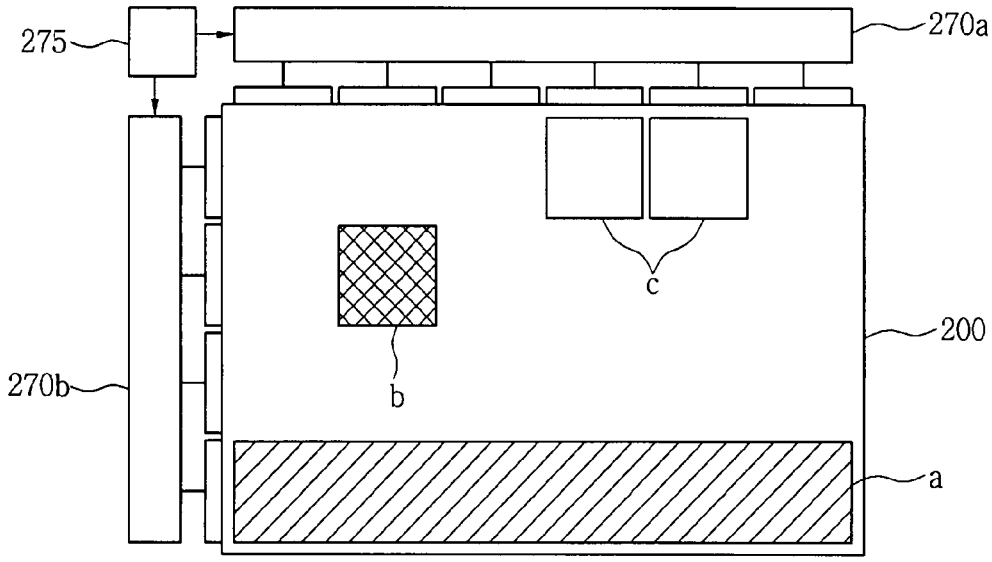
FIG. 13 is a schematic view illustrating the surface light source whose brightness is partially controlled due to the partial driving of the electrode unit.

FIG. 13 illustrates that multiple voltage applying units 270*a* and 270*b* drive respective regions of a partitioned electrode unit on the upper side and a partitioned electrode unit on the lower side of the surface light source 200. In this way, a light emitting surface of the surface light source is controlled to have different brightnesses within respective regions of the area of the light source.

Voltages are differently applied to the respective regions of the horizontally and vertically partitioned electrode units so that regions a, b, and c of the light emitting surface of the surface light source can simultaneously vary in brightness relative to each other.

The regional voltages transmitted to the multiple voltage applying units 270*a* and 270*b* are preferably controlled in association with a panel driving signal of the liquid crystal display. Thus, the surface light source or the backlight unit may further include an electrode data controller 275 to differently control the voltages to be applied by the multiple voltage applying units to the regions of the electrode units such that the voltages are applied to the respective regions of the electrode units in accordance with the control signal, the control signal varying in association with a screen information of the liquid crystal display.

Figure 14:
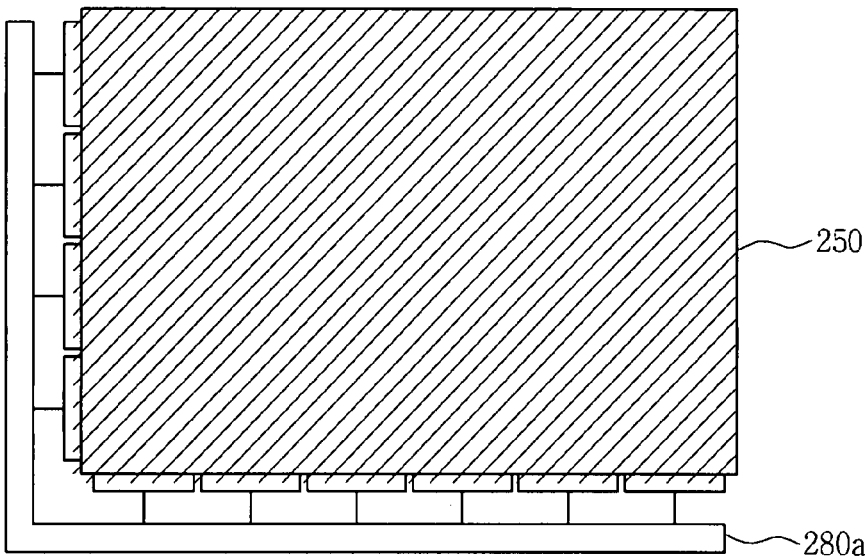
FIGS. 14 and 15 are plan views illustrating an electrode unit partially driven according to another embodiment of the present invention.
Figure 15:
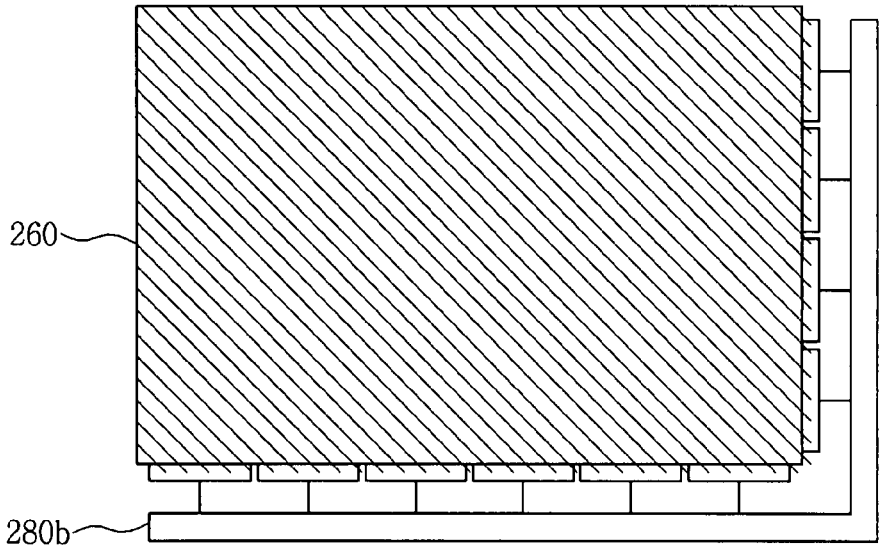
Figure 16:
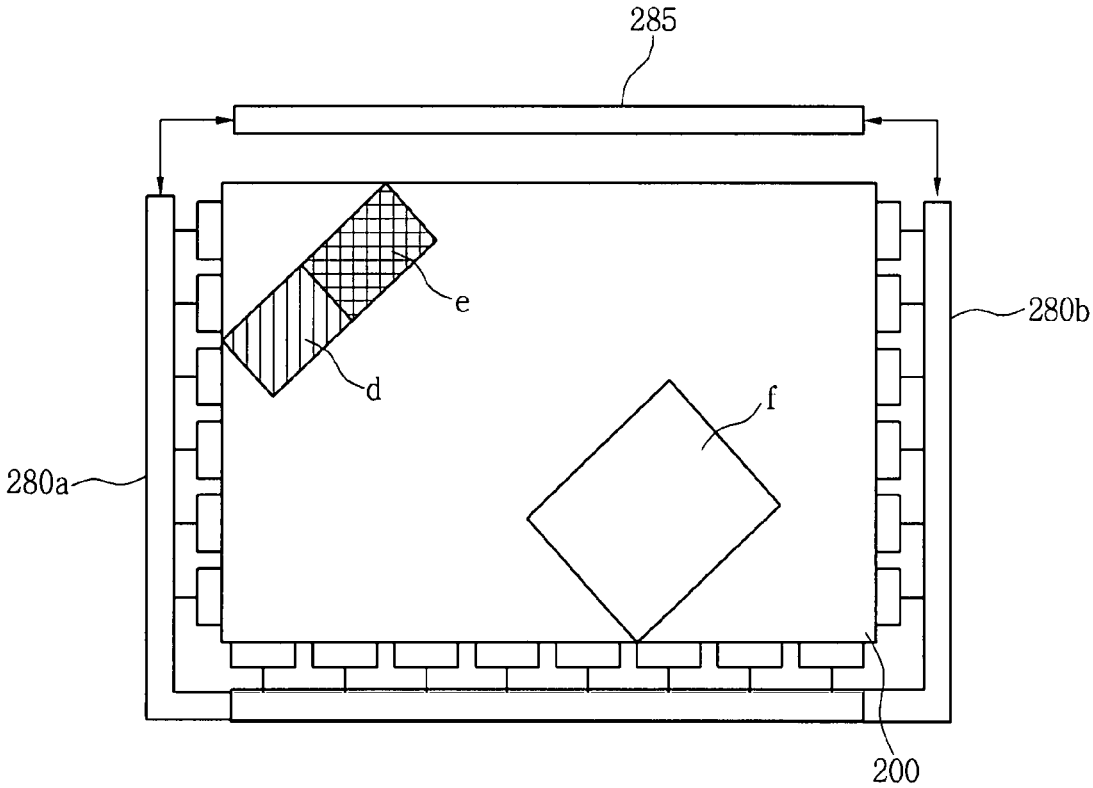
FIG. 16 is a schematic view illustrating the surface light source whose brightness is partially controlled due to the partial driving of the electrode unit.

FIGS. 14 and 15 illustrate electrode patterns obliquely formed different from the electrode patterns of the previous embodiment of the present invention. As illustrated, the electrode units are partitioned into a plurality of regions and multiple voltage applying units 280*a* and 280*b* drive the respective regions. As a result, the light emitting surface of the surface light source, as illustrated in FIG. 16, may be configured such that partial regions d, e, and f vary in brightness. The brightness of individual regions of the surface light source may be controlled by an electrode data controller 285 in association with display information. In such case, a more clear and natural high quality image can be provided.

Figure 17:
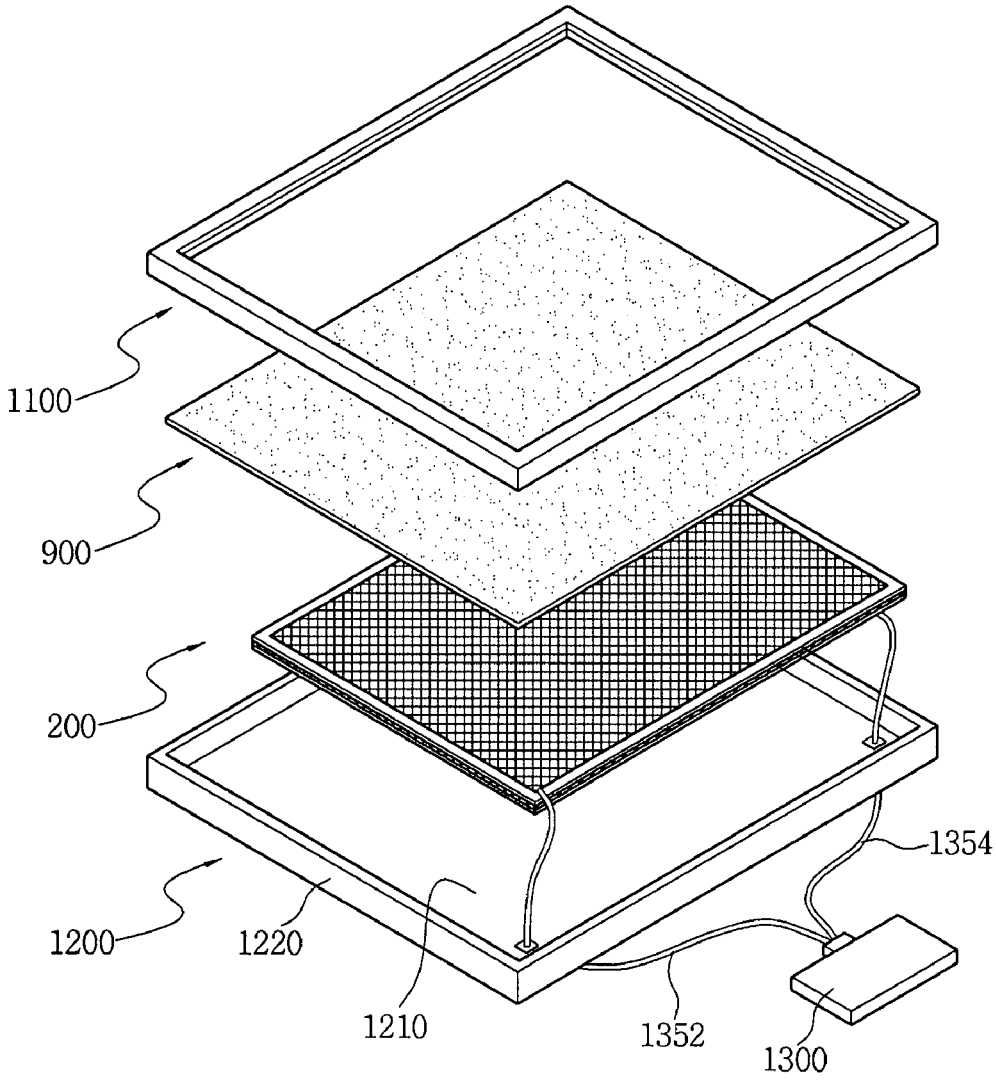
FIG. 17 is an exploded perspective view illustrating a backlight unit including the surface light source according to the embodiment of the present invention.

FIG. 17 is an exploded perspective view illustrating a backlight unit including a very thin surface light source according to an embodiment of the present invention. As illustrated, the backlight unit includes a surface light source 200, upper and lower cases 1100 and 1200, an optical sheet 900, and an inverter 1300. The lower case 1200 includes a bottom 1210 to accommodate the surface light source 200 and a plurality of sidewalls 1220 extended from edges of the bottom 1210 to form an accommodating space. The surface light source 200 is accommodated in the accommodating space of the lower case 1200.

The inverter 1300 is disposed on the rear side of the lower case 1200 and generates a discharging voltage to drive the surface light source 200. The discharging voltage generated by the inverter 1300 is applied to the electrode units of the surface light source 200 through first and second power source lines 1352 and 1354. The optical sheet 900 may include a diffusion plate to uniformly diffuse a light beam emitted from the surface light source 200 and a prism sheet to collimate the diffused light beam. The upper case 1100 is coupled with the lower case 1200 to support the surface light source 200 and the optical sheet 900. The upper case 1100 prevents the surface light source 200 from being separated from the lower case 1200.

Different from as illustrated in the drawings, the upper case 1100 and the lower case 1200 may be integrally formed into a single case. On the other hand, the backlight unit according to the embodiment of the present invention may not include the optical sheet 900 because of excellent brightness and brightness uniformity of the surface light source.

According to the present invention, the plate type electrode unit formed on the surface of the light source body of the surface light source is partitioned into a plurality of regions and voltages are applied to individual ones of the respective regions so that the brightness of each region can be individually controlled. In this way, a surface light source can be dimmed within various regions under local control in response to screen information of the liquid crystal display to permit a high quality image to be obtained.

The invention has been described using preferred exemplary embodiments. However, it is to be understood that the scope of the invention is not limited to the disclosed embodiments. On the contrary, the scope of the invention is intended to include various modifications and alternative arrangements within the capabilities of persons skilled in the art using presently known or future technologies and equivalents. The scope of the claims, therefore, should be accorded the broadest interpretation so as to encompass all such modifications and similar arrangements.

The invention claimed is:

1. A surface light source comprising:

a plate type light source body having a sealed discharging space formed therein;

a plate type electrode unit comprising a first surface electrode on or adjacent a first outer major surface of the light source body, and a second surface electrode on or adjacent a second outer major surface of the light source body, wherein each of the first surface electrode and the second surface electrode is electrically partitioned into a plurality of regions such that at least one of the plurality of regions of the first surface electrode is partitioned in a first direction and at least one of the plurality of regions of the second surface electrode is partitioned in a second direction different from the first direction; and a multiple voltage applying unit operable to apply voltages differently to each of the plurality of regions, so as to independently vary a brightness of the light emitted by each of the plurality of regions.

2. The surface light source of claim 1, wherein the electrode unit comprises electrode patterns spaced apart from each other.

3. The surface light source of claim 1, wherein the light source body comprises:

a plate type first substrate;

a plate type second substrate separated from the first substrate by a predetermined distance; and a sealing member formed on edges between the first and second substrates to seal an inner space between the first and second substrates.

4. The surface light source of claim 3, further comprising at least one spacer inserted between the first and second substrates.

5. The surface light source of claim 1, wherein the electrode unit comprises:

a base layer;

an electrode pattern joined to an upper side of the base layer; and a protective layer overlying an upper side of the electrode pattern and the base layer.

6. The surface light source of claim 5, wherein the base layer and the protective layer have a property of transmitting visible rays therethrough.

7. The surface light source of claim 5, wherein the electrode pattern comprises a circular pattern, an oval pattern, a regular polygonal pattern, a net-structured pattern, or a stripe type pattern.

8. The surface light source of claim 5, wherein the electrode pattern is made of one selected from copper, silver, gold, aluminum, ITO, nickel, chrome, carbon-based conductive material, conductive polymer, and a mixture thereof.

9. The surface light source of claim 1, wherein the electrode unit has an open ratio that is equal to or higher than 60%, the open ratio defined as a ratio of an area of one of the first or the second outer major surfaces that is not taken up by the respective surface electrode relative to a total area of the respective outer major surface.

10. The surface light source of claim 1, wherein a mercury excluded discharging gas is injected into the light source body.

11. A method of operating a surface light source comprising:

applying voltages differently to each of a plurality of partitioned regions of a plate type electrode unit having a property of transmitting visible rays therethrough on a plate type light source body having a sealed discharging space, the plate type electrode unit including a first surface electrode on or adjacent a first outer major surface of the light source body, and a second surface electrode on or adjacent a second outer major surface of the light source body, wherein each of the first surface electrode and the second surface electrode is electrically partitioned into a plurality of regions such that at least one of the plurality of regions of the first surface electrode is partitioned in a first direction and at least one of the plurality of regions of the second surface electrode is partitioned in a second direction different from the first direction;

wherein the applying voltages differently to each of the plurality of regions is performed so as to independently vary a brightness of the light emitted by each of the plurality of regions.

12. The method of claim 11, wherein the voltages are applied to the respective regions in accordance with a control signal associated with screen information of a liquid crystal display.

13. A backlight unit comprising:

a surface light source comprising:

a plate type light source body having a sealed discharging space formed therein;

a plate type electrode unit comprising a first surface electrode on or adjacent a first outer major surface of the light source body, and a second surface electrode on or adjacent a second outer major surface of the light source body, wherein each of the first surface electrode and the second surface electrode is electrically partitioned into a plurality of regions such that at least one of the plurality of regions of the first surface electrode is partitioned in a first direction and at least one of the plurality of regions of the second surface electrode is partitioned in a second direction different from the first direction; and a multiple voltage applying unit operable to apply voltages differently to each of the plurality of regions, so as to independently vary a brightness of the light emitted by each of the plurality of regions; and a case accommodating the surface light source.

14. The backlight unit of claim 13, wherein the multiple voltage applying unit includes an inverter, operable to apply voltages independently to each of the first and second surface electrodes.

15. The backlight unit of claim 13, further comprising an electrode data controller to differently control voltages applied to the respective regions by the multiple voltage applying unit.

16. The surface light source of claim 1, wherein the first surface electrode and the second surface electrode are electrically partitioned in perpendicular directions to each other.

* * * * *